US011628546B2

(12) United States Patent
Chang

(10) Patent No.: US 11,628,546 B2
(45) Date of Patent: Apr. 18, 2023

(54) TOOL CONNECTING ROD

(71) Applicant: Unitek Enterprise Corp., Belize (BZ)

(72) Inventor: Yeh-Ching Chang, Taichung (TW)

(73) Assignee: UNITEK ENTERPRISE CORP., Belize (BZ)

( * ) Notice: Subject to any disclaimer, the term of this patent is extended or adjusted under 35 U.S.C. 154(b) by 40 days.

(21) Appl. No.: 17/353,218

(22) Filed: Jun. 21, 2021

(65) Prior Publication Data

US 2022/0402104 A1 Dec. 22, 2022

(51) Int. Cl.
*B25B 23/00* (2006.01)
*B25B 23/12* (2006.01)

(52) U.S. Cl.
CPC ..... *B25B 23/0035* (2013.01); *B25B 23/0021* (2013.01); *B25B 23/12* (2013.01)

(58) Field of Classification Search
CPC ... B25B 23/0335; B25B 23/021; B25B 23/12; B25B 23/02; B25B 23/08; B25B 21/00; B25B 13/065
USPC ..... 81/177.2, 125, 124.4, 124.5
See application file for complete search history.

(56) References Cited

U.S. PATENT DOCUMENTS 5,048,379 A * 9/1991 Gramera ..... B25B 13/06 81/121.1
9,272,395 B2 * 3/2016 Hui ..... B25B 13/065
11,292,109 B2 * 4/2022 Abbott ..... B23B 31/1071
11,325,230 B2 * 5/2022 Chiang ..... B25B 23/0035
2006/0145431 A1 * 7/2006 Chang ..... B25B 23/12 279/74
2014/0251091 A1 * 9/2014 Hui ..... B25B 13/065 81/124.4
2016/0311091 A1 * 10/2016 Wang ..... B23B 31/1071
2021/0205967 A1 * 7/2021 Chiang ..... B25B 23/12
2021/0308842 A1 * 10/2021 Abbott ..... B25B 23/0035

* cited by examiner

*Primary Examiner* — Don M Anderson
*Assistant Examiner* — Jason Khalil Hawkins
(74) *Attorney, Agent, or Firm* — Muncy, Geissler, Olds & Lowe, P.C.

(57) ABSTRACT

A tool connecting rod is provided, including: a main body, a sleeve member and a magnetic mechanism. The main body includes a driving portion and an assembling portion opposite to the driving portion, and the assembling portion has an assembling hole extending in an axial direction. The sleeve member is non-rotatably disposed on the assembling portion and includes at least one sleeving hole configured to be connected with a connecting member. The magnetic mechanism is disposed within the assembling hole and includes a magnetic member penetrating into the sleeve member and an elastic member abutted against and between the main body and the magnetic member. In a circumferential direction of the magnetic member, a first gap is defined between the sleeve member and the magnetic member so that the sleeve member and the magnetic member are movable radially relative to each other.

8 Claims, 10 Drawing Sheets

TOOL CONNECTING ROD

BACKGROUND OF THE INVENTION

Field of the Invention

The present invention relates to a tool connecting rod.

Description of the Prior Art

A conventional tool connecting rod 100 (please refer to FIGS. 9 and 10) includes a rod body 101 and a sleeve 102 non-rotatably sleeved to the rod body 101, and the sleeve 102 is configured to be assembled with a connecting member 200 (such as bits, screws, nuts, or the like). One end of the rod body 101 is configured to be assembled with a driving tool to drive the tool connecting rod 100 to rotate, and the other end of the rod body 101 penetrates into the sleeve 102 and has a magnetic member 103 disposed thereon for attracting the connecting member 200.

However, a diametrical dimension of the rod body 101 usually corresponds to a diametrical dimension of the sleeve 102 so that the rod body 101 and the sleeve 102 are unmovable radially relative to each other. Therefore, the magnetic member 103 is easy to be damaged due to impact of the connecting member 200 when the tool connecting rod 100 is driven to drive the connecting member 200 to rotate. In addition, a relative position of the magnetic member 103 and the sleeve 102 is inaccurate due to manufacturing tolerances. For example, when the rod body 101 is too short or the sleeve 102 is too long, a length of the magnetic member 103 protruding into an assembling hole of the sleeve 102 is not long enough so that a gap 104 is formed between the magnetic member 103 and the connecting member 200, as shown in FIG. 9, which results in insufficient magnetic attraction of the magnetic member 103 to the connecting member 200. When the rod body 101 is too long or the sleeve 102 is too short, the magnetic member 103 excessively protrudes into the assembling hole so that the connecting member 200 cannot be sufficiently inserted into the assembling hole and an interval 105 is formed between the connecting member 200 and the sleeve 102, as shown in FIG. 10, which results in poor operational stability, poor force transmission and damage to the magnetic member 103. As a result, the conventional tool connecting rod 100 requests low manufacturing tolerances, which is high cost.

The present invention is, therefore, arisen to obviate or at least mitigate the above-mentioned disadvantages.

SUMMARY OF THE INVENTION

The main object of the present invention is to provide a tool connecting rod, which is easy to manufacture and is durable.

To achieve the above and other objects, the present invention provides a tool connecting rod, including: a main body, a sleeve member and a magnetic mechanism. The main body includes a driving portion and an assembling portion opposite to the driving portion, and the assembling portion has an assembling hole extending in an axial direction. The sleeve member is non-rotatably disposed on the assembling portion and includes at least one sleeving hole configured to be connected with a connecting member. The magnetic mechanism is disposed within the assembling hole and includes a magnetic member penetrating into the sleeve member and an elastic member abutted against and between the main body and the magnetic member. In a circumferential direction of the magnetic member, a first gap is defined between the sleeve member and the magnetic member so that the sleeve member and the magnetic member are movable radially relative to each other.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Please refer to FIGS. 1 to 8 for a preferable embodiment of the present invention. A tool connecting rod 1 of the present invention includes a main body 10, a sleeve member 20 and a magnetic mechanism 30.

Figure 1:
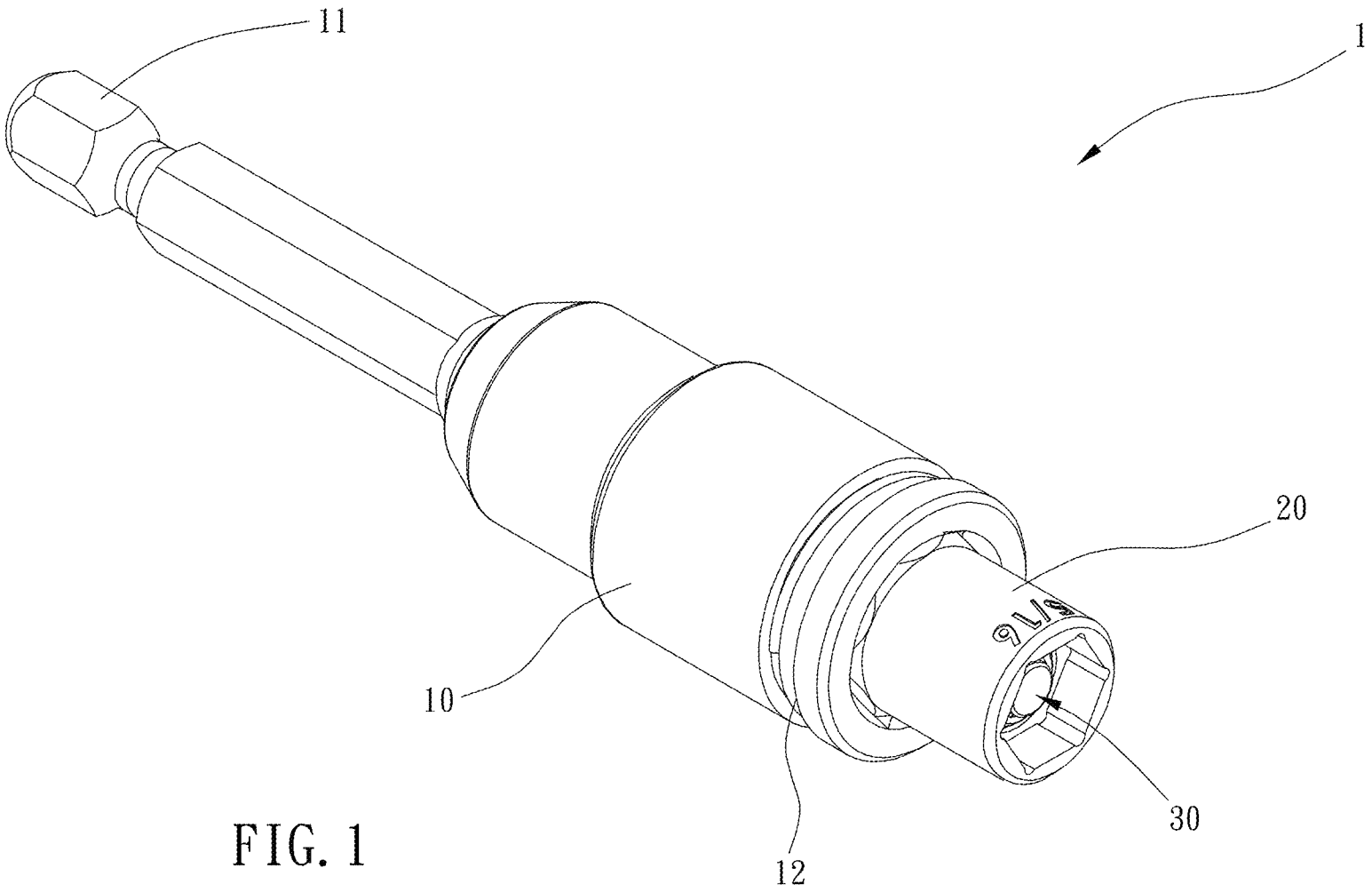
FIG. 1 is a stereogram of a preferable embodiment of the present invention.
Figure 2:
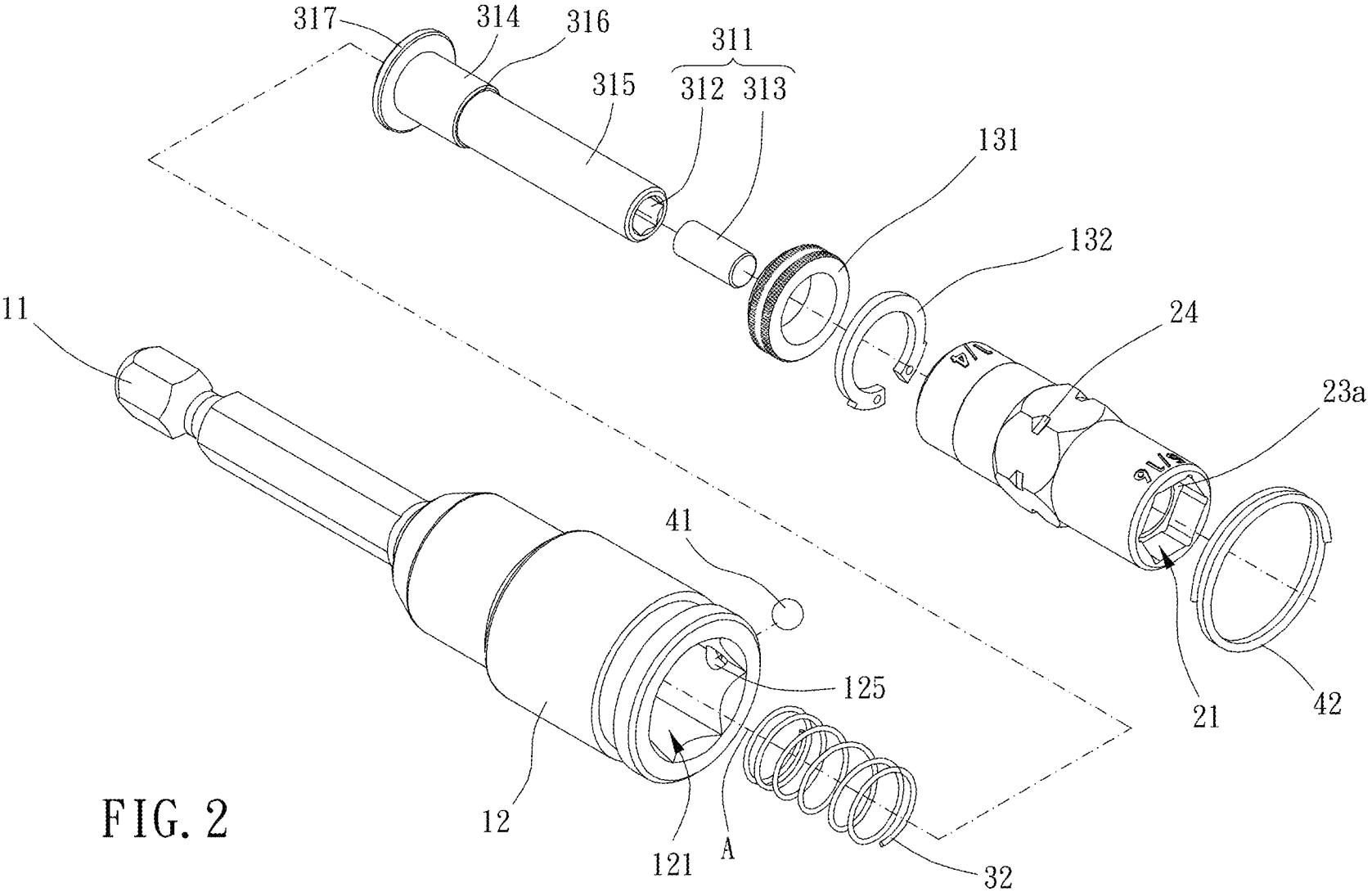
FIG. 2 is a breakdown drawing of a preferable embodiment of the present invention.
Figure 3:
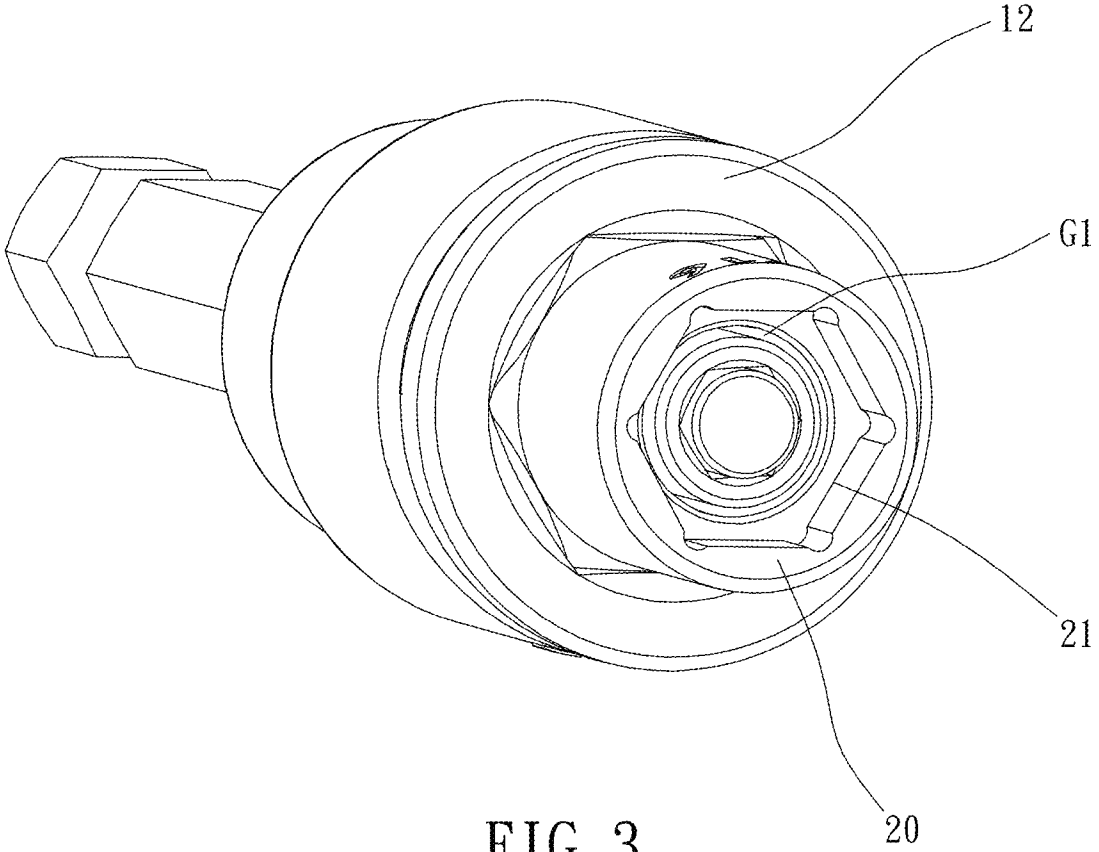
FIG. 3 is another stereogram of a preferable embodiment of the present invention.
Figure 4:
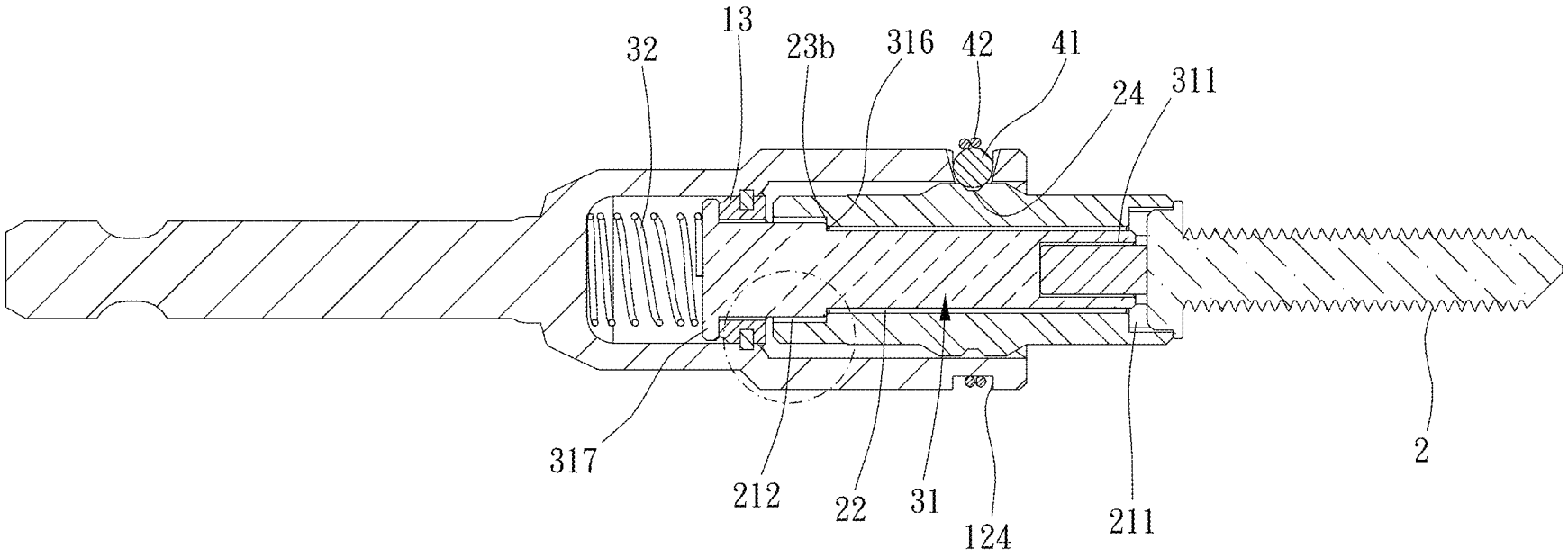
FIGS. 4 and 5 are cross-sectional views showing operation according to a preferable embodiment of the present invention.
Figure 5:
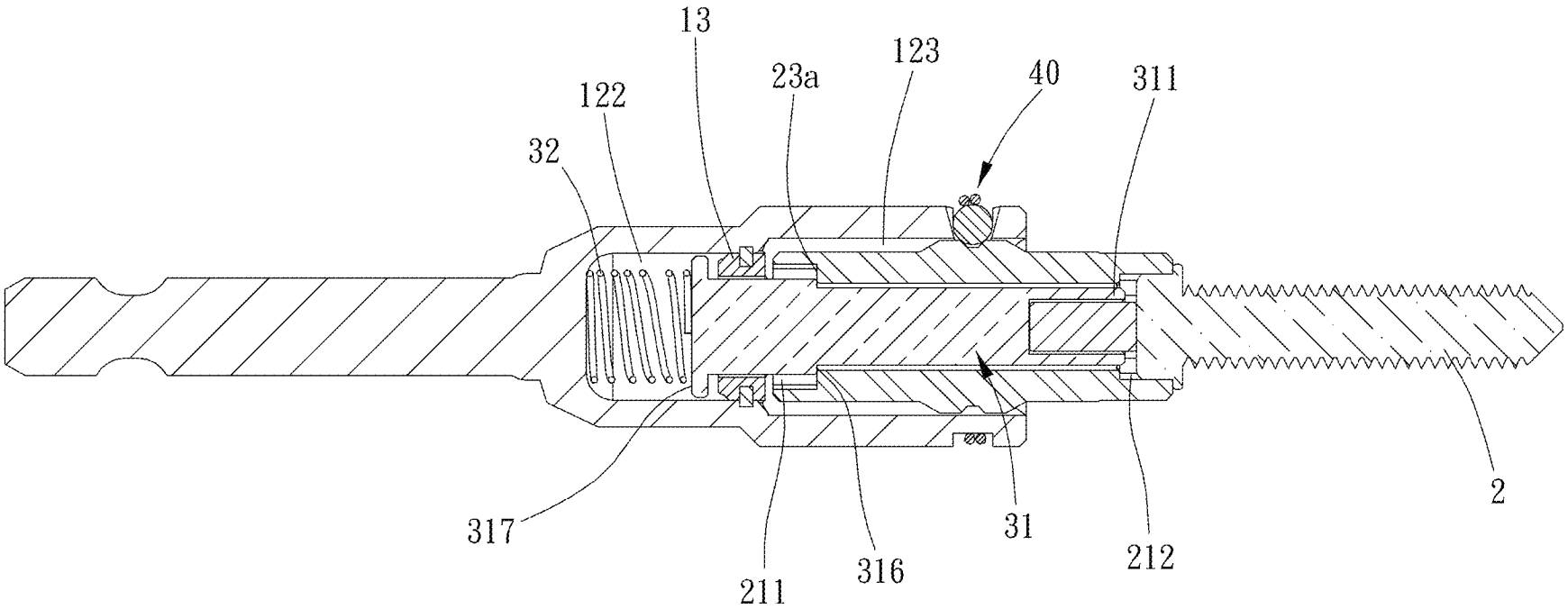

The main body 10 includes a driving portion 11 and an assembling portion 12 opposite to the driving portion 11, and the assembling portion 12 has an assembling hole 121 extending in an axial direction A. The sleeve member 20 is non-rotatably disposed on the assembling portion 12 and includes at least one sleeving hole 21 configured to be connected with a connecting member 2. The magnetic mechanism 30 is disposed within the assembling hole 121 and includes a magnetic member 31 penetrating into the sleeve member 20 and an elastic member 32 axially abutted against and between the main body 10 and the magnetic member 31, as shown in FIGS. 4 and 5. In a circumferential direction of the magnetic member 31, a first gap G1 is defined between the sleeve member 20 and the magnetic member 31 so that the sleeve member 20 and the magnetic member 31 are movable radially relative to each other. Therefore, the elastic member 32 allows the magnetic member 31 to have a tendency to move in a direction toward the at least one sleeving hole 21 for high tolerance and easy manufacturing. When the driving portion 11 is driven to drive the connecting member 2 to rotate, the elastic member 32 and the first gap G1 allow the magnetic member 31 to move relative to the sleeve member 20, which effectively prevents the magnetic member 31 from impact and damage so as to have good durability.

Figure 8:
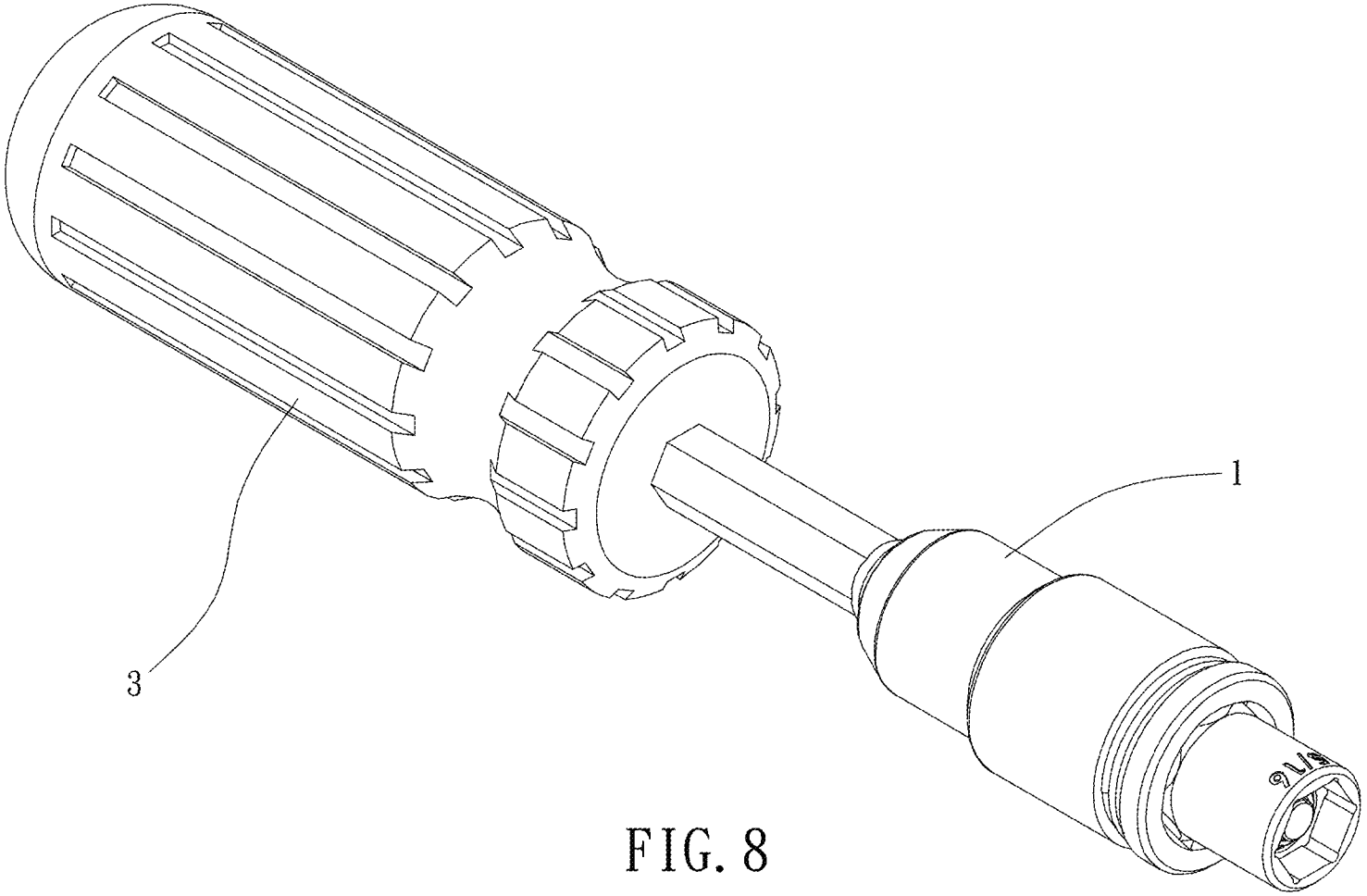
FIG. 8 is a stereogram showing application according to a preferable embodiment of the present invention.
Figure 9:
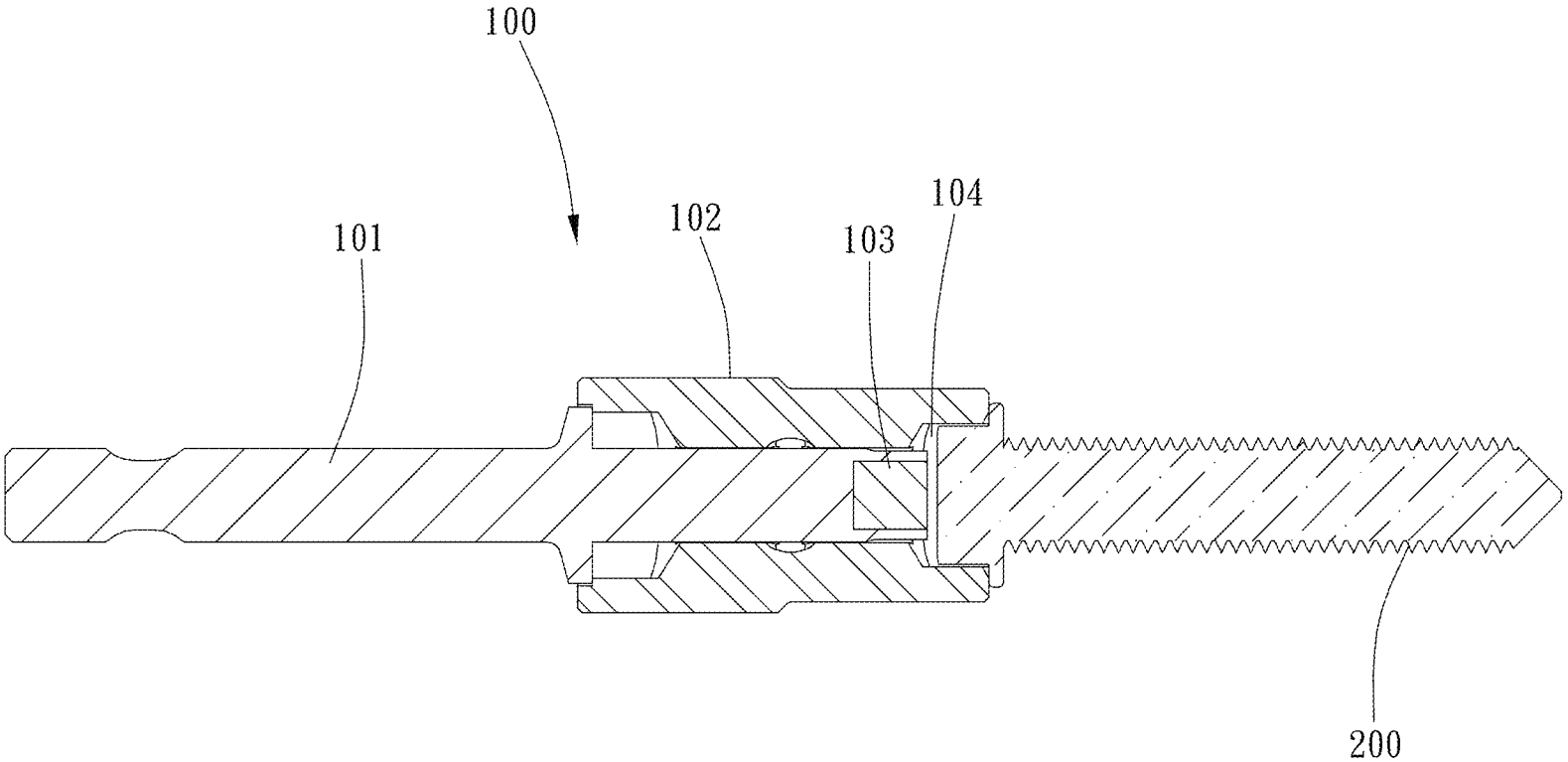
FIG. 9 PRIOR ART
FIG. 9 is a cross-sectional view of a conventional tool connecting rod.
Figure 10:
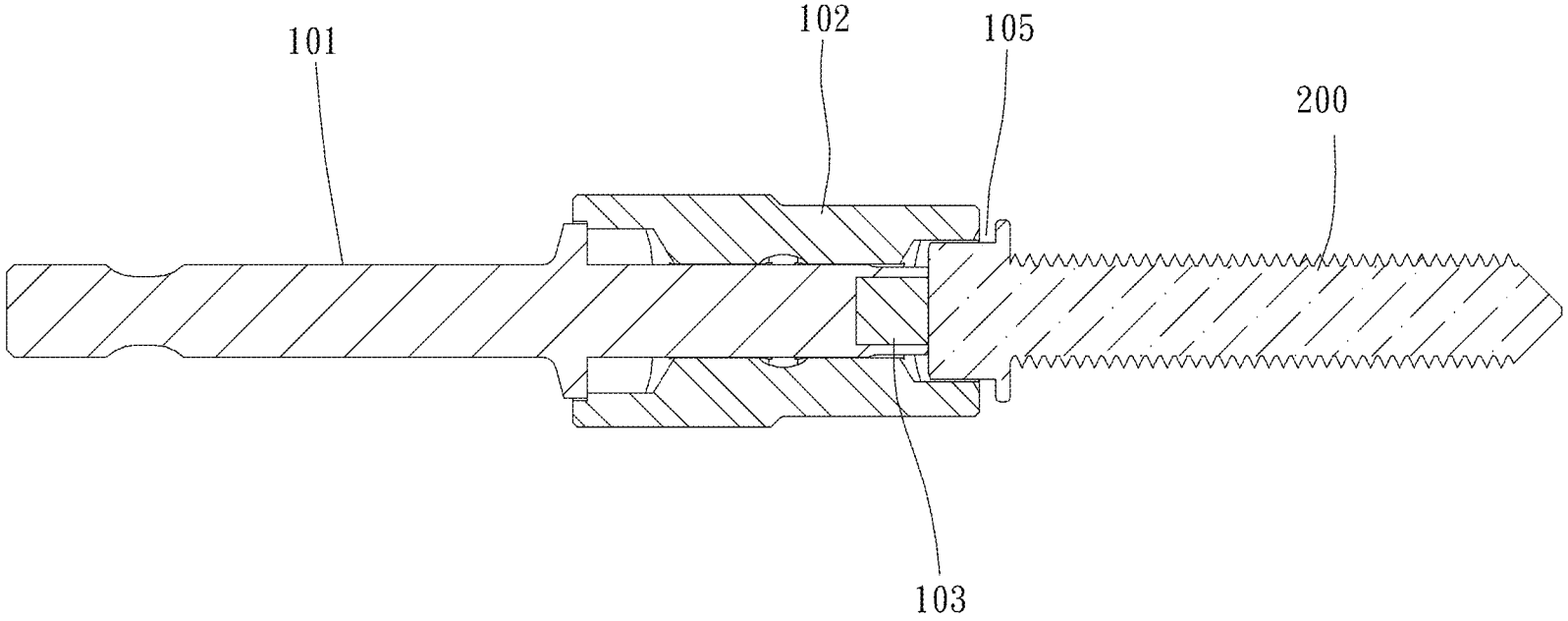
FIG. 10 PRIOR ART
FIG. 10 is a cross-sectional view of another conventional tool connecting rod.

The driving portion 11 is configured to be assembled with a pneumatic tool, an electric tool, a handle 3 (as shown in FIG. 8) or the like, which has a wide range of applications. The connecting member 2 may be a screw, a nut, a socket or a screwdriver, or the like. Specifically, the sleeve member 20 further includes a penetrating groove 22 communicated with each of the at least one sleeving hole 21, and a diametrical dimension of the penetrating groove 22 is smaller than a diametrical dimension of each of the at least one sleeving hole 21. The first gap G1 is defined between a groove wall of the penetrating groove 22 and the magnetic member 31. In this embodiment, the first gap G1 extends annularly in the circumferential direction and allows the magnetic member 31 to move (rotate or swing radially) relative to the sleeve member 20 so as to have good freedom of movement. As viewed in the axial direction A, the first gap G1 is larger than or equal to 0.5 mm (smaller or equal to 1 mm, preferably) so as to provide a sufficient margin of movement and stable assembling. The magnetic member 31 includes a magnetic end portion 311, and the magnetic end portion 311 at least partially protrudes beyond the penetrating groove 22 and extends into one of the at least one sleeving hole 21 so as to provide sufficient magnetic attraction to the connecting member 2. Specifically, the magnetic end portion 311 includes a recess 312 and a magnet 313 received within the recess 312, and the magnet 313 preferably axially protrudes beyond the recess 312 to have good magnetic attraction effect. However, in the circumferential direction, the groove wall of the penetrating groove may partially contact the magnetic member and defined one or more said first gaps; the magnet may be flushed with the recess; the magnetic end portion may be directly connected with one said magnet without the recess.

The tool connecting rod 1 further includes a restriction mechanism 40, and the restriction mechanism 40 includes at least one restriction member 41 retractably protruding from an inner circumferential wall of the assembling portion 12. An outer circumferential wall of the sleeve member 20 has at least one engaging groove 24 which is engageable with the at least one restriction member 41 so that the sleeve member 20 is detachably assembled with the assembling portion 12. In this embodiment, an outer circumferential wall of the assembling portion 12 has an annular groove 124 disposed thereon, and a bottom side of the annular groove 124 has at least one through hole 125 communicating the annular groove 124 with the assembling hole 121. Each of the at least one restriction member 41 is received within one of the at least one through hole 125. The restriction mechanism 40 further includes a resilient member 42 received within the annular groove 124 and radially biased against the at least one restriction member 41 toward the assembling hole 121 so that the at least one restriction member 41 has a tendency to radially move in a direction toward the assembling hole 121. Each of the at least one restriction member 41 is a steel ball, and the resilient member 42 is a coil spring sleeved around the annular groove 124, which has a simple structure and is easy to process and manufacture. In other embodiments, the restriction mechanism may have a plurality of said restriction members; the restriction mechanism may have a plurality of said resilient members respectively corresponding to one said restriction member; the at least one restriction member may be a blocking projection selectively protruding into the assembling hole.

Figure 6:
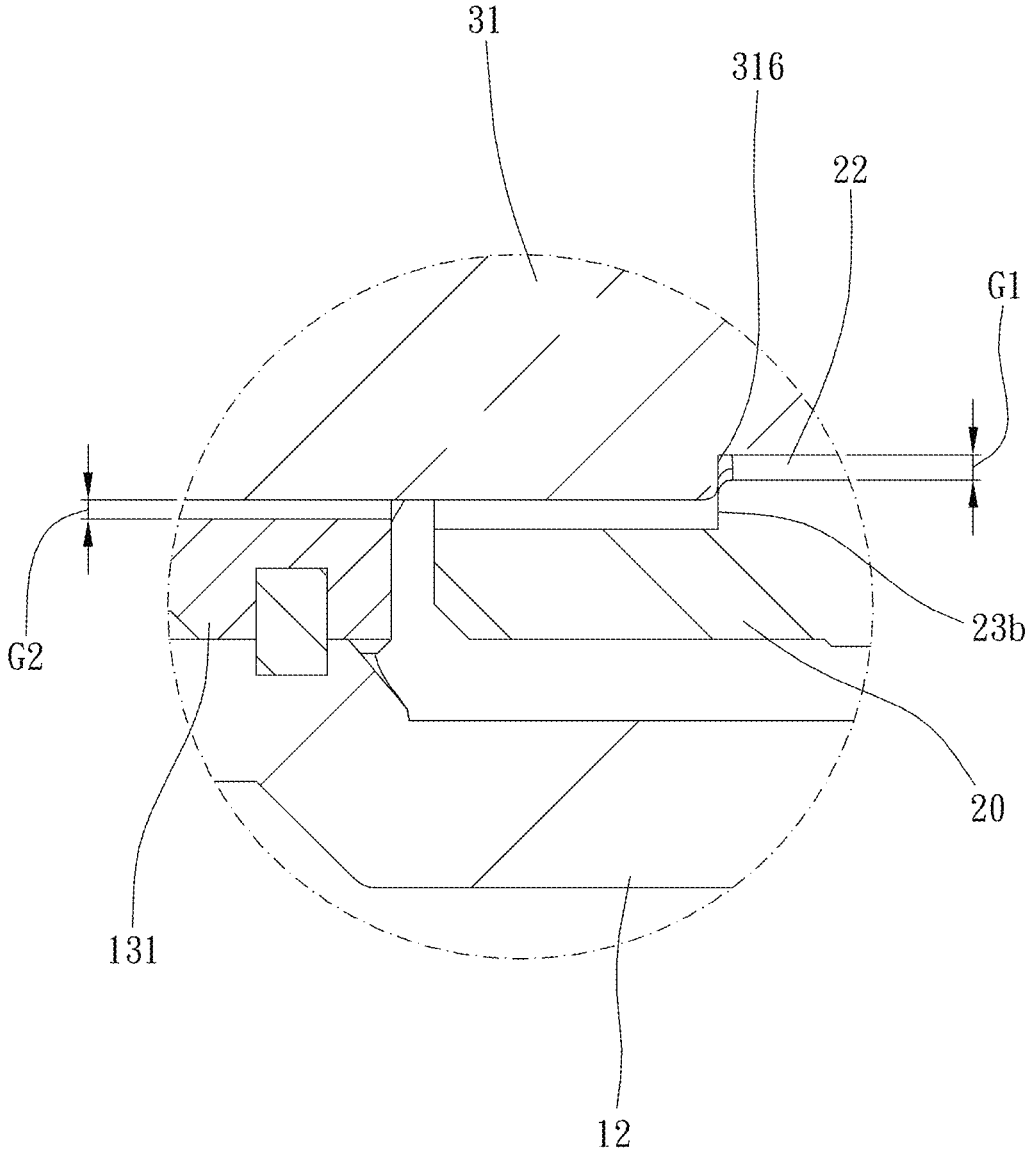
FIG. 6 is a partial enlargement of FIG. 4.
Figure 7:
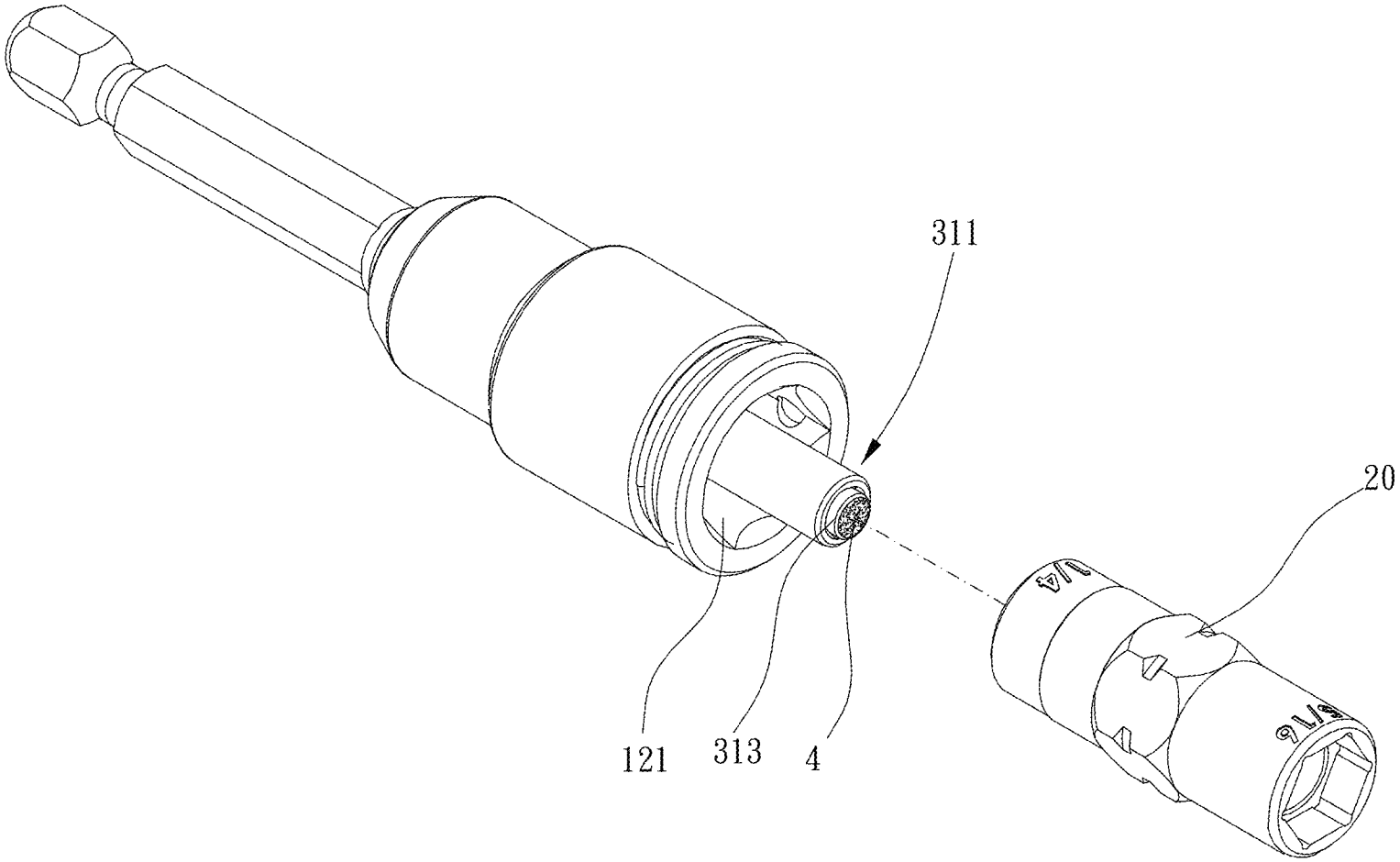
FIG. 7 is a schematic diagram of a preferable embodiment of the present invention in use.

Please refer to FIGS. 4 to 7, the sleeve member 20 is detachably disposed within the assembling hole 121, and the magnetic end portion 311 preferably protrudes axially beyond the assembling hole 121 so that iron filings attached to the magnet 313 is easy to be cleaned after detaching the sleeve member 20, as shown in FIG. 7. The at least one sleeving hole 21 includes a first sleeving hole 211 and a second sleeving hole 212 which are disposed on two opposite sides of the penetrating groove 22. A first blocking shoulder 23*a* is disposed between the first sleeving hole 211 and the penetrating groove 22, and a second blocking shoulder 23*b* is disposed between the second sleeving hole 212 and the penetrating groove 22. The first blocking shoulder 23*a* and the second blocking shoulder 23*b* are respectively blockable with the magnetic member 31 in the axial direction A so that a length of the magnetic member 31 protruding into one of the first sleeving hole 211 and the second sleeving hole 212 is unchanged. The first sleeving hole 211 and the second sleeving hole 212 are different from each other in at least one of a shape, a diametrical dimension and an axial depth so that the sleeve member 20 is applicable to different types of said connecting members by adjusting an assembling direction of the sleeve member 20.

Moreover, the assembling portion 12 includes a blocking portion 13 radially protruding therefrom. The magnetic member 31 includes a large diameter section 314, a small diameter section 315 and a shoulder portion 316 connected between the large diameter section 314 and the small diameter section 315, and the large diameter section 314 has a head portion 317 which is axially blockable with the blocking portion 13. The shoulder portion 316 is axially abutted against the sleeve member 20. Therefore, the head portion 317 and the blocking portion 13 avoid the magnetic member 31 detaching from the assembling hole 121, and the shoulder portion 316 is axially abutted against one of the first blocking shoulder 23*a* and the second blocking shoulder 23*b* to match one of said sleeving holes with different axial depths. For example, when an end of the sleeve member 20 having the second sleeving hole 212 is inserted into the assembling hole 121 and the second blocking shoulder 23*b* is abutted against the shoulder portion 316, a portion of the large diameter section 314 extends into the second sleeving hole 212 and the magnetic end portion 311 extends into the first sleeving hole 211, as shown in FIGS. 4 and 6. When an end of the sleeve member 20 having the first sleeving hole 211 is inserted into the assembling hole 121 and the first blocking shoulder 23*a* is abutted against the shoulder portion 316, since the first sleeving hole 211 has a smaller axial depth relative to the second sleeving hole 212, the elastic member 32 is compressed by the head portion 317 and the magnetic member 31 is moved toward the driving portion 11, which prevents the magnetic end portion 311 from excessively protruding into the second sleeving hole 212, as shown in FIG. 5. With configurations as described above, a distance that the magnetic end portion 311 extending into the at least one sleeving hole 21 is effectively restricted and the influence of manufacturing tolerances is reduced so that a manufacturing cost of the tool connecting rod 1 is reduced.

The large diameter section 314 is disposed through the blocking portion 13. In the circumferential direction, a second gap G2 is defined between the large diameter section 314 and the blocking portion 13, which allows movement of the magnetic member 31 to avoid damage to components. In this embodiment, the assembling hole 121 includes a first segment 122 adjacent to the driving portion 11 and a second segment 123 communicated with the first segment 122 and open outwardly, and a diametrical dimension of the first segment 122 is smaller than a diametrical dimension of the second segment 123. The first segment 122 has the blocking portion 13 disposed thereon, and the second segment 123 receives the sleeve member 20 therewithin. The blocking portion 13 includes a restricting ring 131 being axially interferable with the head portion 317 and an engaging member 132 connected the assembling portion 12 with the restricting ring 131 for stable restriction and easy assembling. However, the restricting ring may be connected with the assembling portion in tight-fit without the engaging member; the assembling portion may have the blocking portion integrally protruding therefrom.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A tool connecting rod, including:

a main body, including a driving portion and an assembling portion opposite to the driving portion, the assembling portion having an assembling hole extending in an axial direction;

a sleeve member, non-rotatably disposed on the assembling portion and including at least one sleeving hole configured to be connected with a connecting member; and a magnetic mechanism, disposed within the assembling hole, including a magnetic member penetrating into the sleeve member and an elastic member axially abutted against and between the main body and the magnetic member;

wherein in a circumferential direction of the magnetic member, a first gap is defined between the sleeve member and the magnetic member so that the sleeve member and the magnetic member are movable radially relative to each other;

wherein the tool connecting rod further includes a restriction mechanism, the restriction mechanism includes at least one restriction member retractably protruding from an inner circumferential wall of the assembling portion, and an outer circumferential wall of the sleeve member has at least one engaging groove which is engageable with the at least one restriction member;

wherein an outer circumferential wall of the assembling portion has an annular groove disposed thereon, a bottom side of the annular groove has at least one through hole communicating the annular groove with the assembling hole, each of the at least one restriction member is received within one of the at least one through hole, and the restriction mechanism further includes a resilient member received within the annular groove and radially biased against the at least one restriction member toward the assembling hole.

2. The tool connecting rod of claim 1, wherein the sleeve member further includes a penetrating groove communicated with each of the at least one sleeving hole, a diametrical dimension of the penetrating groove is smaller than a diametrical dimension of each of the at least one sleeving hole, and the first gap is defined between a groove wall of the penetrating groove and the magnetic member.

3. The tool connecting rod of claim 2, wherein the magnetic member includes a magnetic end portion, and the magnetic end portion at least partially protrudes beyond the penetrating groove and extends into one of the at least one sleeving hole.

4. The tool connecting rod of claim 2, wherein the sleeve member is detachably disposed within the assembling hole, the at least one sleeving hole includes a first sleeving hole and a second sleeving hole which are disposed on two opposite sides of the penetrating groove, a first blocking shoulder is disposed between the first sleeving hole and the penetrating groove, a second blocking shoulder is disposed between the second sleeving hole and the penetrating groove, and the first blocking shoulder and the second blocking shoulder are respectively blockable with the magnetic member in the axial direction.

5. The tool connecting rod of claim 4, wherein the first sleeving hole and the second sleeving hole are different from each other in at least one of a shape, a diametrical dimension and an axial depth.

6. The tool connecting rod of claim 1, wherein the assembling portion includes a blocking portion radially protruding therefrom, the magnetic member includes a large diameter section, a small diameter section and a shoulder portion connected between the large diameter section and the small diameter section, the large diameter section has a head portion which is axially blockable with the blocking portion, and the shoulder portion is axially abutted against the sleeve member.

7. The tool connecting rod of claim 6, wherein the large diameter section is disposed through the blocking portion, and in the circumferential direction, a second gap is defined between the large diameter section and the blocking portion.

8. The tool connecting rod of claim 5, wherein as viewed in the axial direction, the first gap is larger than or equal to 0.5 mm; the magnetic member includes a magnetic end portion, and the magnetic end portion at least partially protrudes beyond the penetrating groove and extends into one of the at least one sleeving hole; the magnetic end portion includes a recess and a magnet received within the recess, the magnet axially protrudes beyond the recess; the resilient member is a coil spring sleeved around the annular groove; the assembling portion includes a blocking portion radially protruding therefrom, the magnetic member includes a large diameter section, a small diameter section and a shoulder portion connected between the large diameter section and the small diameter section, the large diameter section has a head portion which is axially blockable with the blocking portion, and the shoulder portion is axially abutted against one of the first blocking shoulder and the second blocking shoulder; the assembling hole includes a first segment adjacent to the driving portion and a second segment communicated with the first segment and open outwardly, a diametrical dimension of the first segment is smaller than a diametrical dimension of the second segment, the first segment has the blocking portion disposed thereon, the second segment receives the sleeve member therewithin; the blocking portion includes a restricting ring being axially interferable with the head portion and an engaging member connected the assembling portion with the restricting ring; and the large diameter section is disposed through the blocking portion, in the circumferential direction, a second gap is defined between the large diameter section and the blocking portion.

* * * * *